US007412200B2

(12) United States Patent
Gotoh

(10) Patent No.: US 7,412,200 B2
(45) Date of Patent: Aug. 12, 2008

(54) SHEET FEED UNIT OPERABLE WITH SMALLER FORCE AND IMAGE FORMING APPARATUS

(75) Inventor: Hiroyuki Gotoh, Kawasaki (JP)

(73) Assignee: Ricoh Company, Ltd., Toyko (JP)

( * ) Notice: Subject to any disclaimer, the term of this patent is extended or adjusted under 35 U.S.C. 154(b) by 394 days.

(21) Appl. No.: 11/312,383

(22) Filed: Dec. 21, 2005

(65) Prior Publication Data

US 2006/0153609 A1 Jul. 13, 2006

(30) Foreign Application Priority Data

Dec. 21, 2004 (JP) ..... 2004-369341

(51) Int. Cl.
*G03G 15/00* (2006.01)

(52) U.S. Cl. ..... 399/393; 399/23; 399/110; 271/9.01; 271/9.08; 271/145; 400/624; 400/625

(58) Field of Classification Search ..... 399/393, 399/23, 110; 271/9.01, 9.08, 145; 400/624, 400/625

See application file for complete search history.

(56) References Cited

U.S. PATENT DOCUMENTS 6,739,778 B2 * 5/2004 Fuchi et al. ..... 400/693
6,901,239 B2 * 5/2005 Ahn ..... 399/405
2006/0204276 A1 * 9/2006 Takuwa ..... 399/110

FOREIGN PATENT DOCUMENTS

| | | |
|---|---|---|
| JP | 63-277133 | 11/1988 |
| JP | 3-256932 | 11/1991 |
| JP | 06-156753 | 6/1994 |
| JP | 07/117871 | 5/1995 |
| JP | 07-179231 | 7/1995 |
| JP | 9-12164 | 1/1997 |
| JP | 2003-321133 | 11/2003 |

* cited by examiner

*Primary Examiner*—Ren Yan
*Assistant Examiner*—Andy L Pham
(74) *Attorney, Agent, or Firm*—Oblon, Spivak, McClelland, Maier & Neustadt, P.C.

(57) ABSTRACT

A sheet feed unit for use in an image forming apparatus includes a sheet feed unit body and a sheet cassette. The sheet feed unit body includes a first frame and a first contact face provided on the first frame. The sheet cassette, which is withdrawable from the sheet feed unit body, includes a second frame, a second contact face provided on the second frame, and a separator. The second contact face is attached to the first contact face when to set the sheet cassette at a position in the sheet feed unit body. The separator is inserted between the first contact face and the second contact face to separate the sheet cassette and the sheet feed unit body, and is disengaged from the first contact face and the second contact face to set the sheet cassette at the position in the sheet feed unit body.

16 Claims, 4 Drawing Sheets

SHEET FEED UNIT OPERABLE WITH SMALLER FORCE AND IMAGE FORMING APPARATUS

TECHNICAL FIELD

The present disclosure generally relates to a sheet feed unit for use in an image forming apparatus such as copier, facsimile, and printer, and to an image forming apparatus having such sheet feed unit.

BACKGROUND

Conventionally, a sheet feed unit for use in an image forming apparatus includes a sheet feed unit body and a sheet cassette, which is withdrawable from the sheet feed unit body.

The sheet cassette stores a plurality of recording medium such as transfer sheet used for image forming, and the recording medium (e.g., transfer sheet) is fed from the sheet cassette to an image forming section one by one.

As for such sheet feed unit, an operator conducts sheet-refilling or sheet-replacement by withdrawing the sheet cassette from the sheet feed unit body.

In case of the sheet-refilling, the operator refill recording medium (e.g., transfer sheet), and in case of the sheet-replacement, the operator changes the size of the recording medium (e.g., transfer sheet) from one size to another size (e.g., from A4 to A3).

In general, an image forming apparatus includes a sheet feed unit having a locking mechanism to hold a sheet cassette at a predetermined position in the sheet feed unit body, from such position the recording medium (e.g., transfer sheet) is fed for image forming.

Such locking mechanism operation includes one of the steps of: (1) holding by a locking pawl and a spring; (2) holding by a Y-shaped catch mechanism having a pivotable arm, shaft, roller, spring, and frame; (3) holding by a Y-shaped catch mechanism made of resin material, and (4) holding by a leaf spring having a locking shape using elasticity of the leaf spring, for example.

Furthermore, the position of the sheet cassette in the sheet feed unit body is held by another mechanism such as a link mechanism for a sheet-feed position and a sheet-size detection switch provided on the sheet feed unit body, wherein the link mechanism for the sheet-feed position links the sheet cassette and the sheet feed unit body to set sheets to a sheet-feedable position when the sheet cassette is set in the sheet feed unit body, and the sheet-size detection switch detects a sheet size with contacting a sheet selection device provided in the sheet cassette.

Such sheet cassette is slidably configured to the sheet feed unit body, and is withdrawable from the sheet feed unit body, in general.

With such configuration, when an operator withdraws the sheet cassette from the sheet feed unit body for sheet-refilling or sheet-replacement, the operator needs to exert a force to detach the sheet cassette from the sheet feed unit body at the above-mentioned locking mechanism, to exert another force to detach the sheet cassette from the link mechanism for sheet-feed position and sheet-size detection switch, and to exert yet another force to overcome a sliding resistance of sliding portion of the sheet feed unit, for example.

Accordingly, the operator needs to exert a relatively large combined force to withdraw the sheet cassette from the sheet feed unit due to the above-mentioned forces.

Under such configuration, when the operator pushes the sheet cassette into the sheet feed unit body to set the sheet cassette to the sheet-feedable position, the operator receives reactive forces from the locking mechanism, the link mechanism, and the sheet-size detection switch, and sliding resistance at the sliding portion of the sheet feed unit, for example.

Thereby the operator also needs to exert a relatively large force when inserting the sheet cassette into the sheet feed unit body.

With the advent of the barrier-free trend and universal design, manufactures have been requested to produce machines or tools having improved accessibility for people including disabilities. For example, the Rehabilitation Act of the United States requires federal agencies to make their electronic and information technology accessible to people with disabilities.

Under such circumstances, it is desirable to manufacture an image forming apparatus having improved accessibility for people including disabilities. For example, it is preferable that the operator can insert the sheet cassette into the sheet feed body and withdraw the sheet cassette from the sheet feed body with less operating force.

SUMMARY

The present disclosure relates to a sheet feed unit for use in an image forming apparatus. The sheet feed unit includes a sheet feed unit body and a sheet cassette. The sheet feed unit body includes a first frame and a first contact face provided on the first frame. The sheet cassette, which is withdrawable from the sheet feed unit body, includes a second frame, a second contact face provided on the second frame, and a separator. The second contact face is attached to the first contact face when to set the sheet cassette at a position in the sheet feed unit body. The separator is inserted between the first contact face and the second contact face to separate the sheet cassette and the sheet feed unit body, and is disengaged from the first contact face and the second contact face to set the sheet cassette at the position in the sheet feed unit body.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

DETAILED DESCRIPTION OF EXAMPLE EMBODIMENTS

Figure 1:
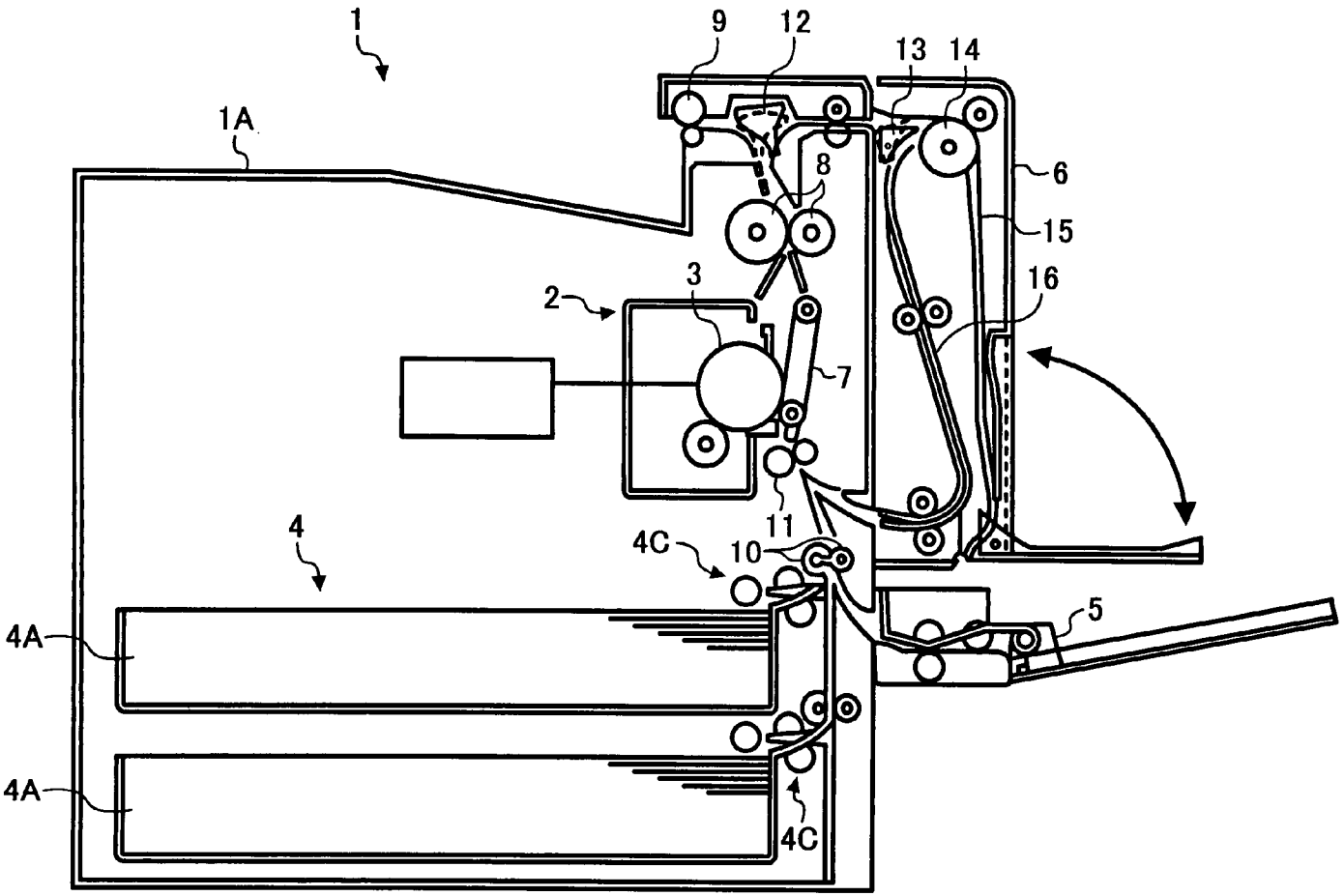
FIG. 1 is a schematic view of an image forming apparatus provided with a sheet feed unit according to an example embodiment.

In describing example embodiments shown in the drawings, specific terminology is employed for the sake of clarity. However, the disclosure of this present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, an example sheet feed unit is described with reference to FIGS. 1 to 6.

FIG. 1 is a schematic view of an image forming apparatus 1 provided with a sheet feed unit according to an example embodiment.

As shown in FIG. 1, the image forming apparatus 1 includes an image forming apparatus body 1A, an image forming unit 2, a sheet feed unit 4, a manual feed unit 5, and a double-face copy unit 6.

The image forming unit 2 includes a photosensitive drum 3 to conduct an image forming by electro-photography process.

Figure 3:
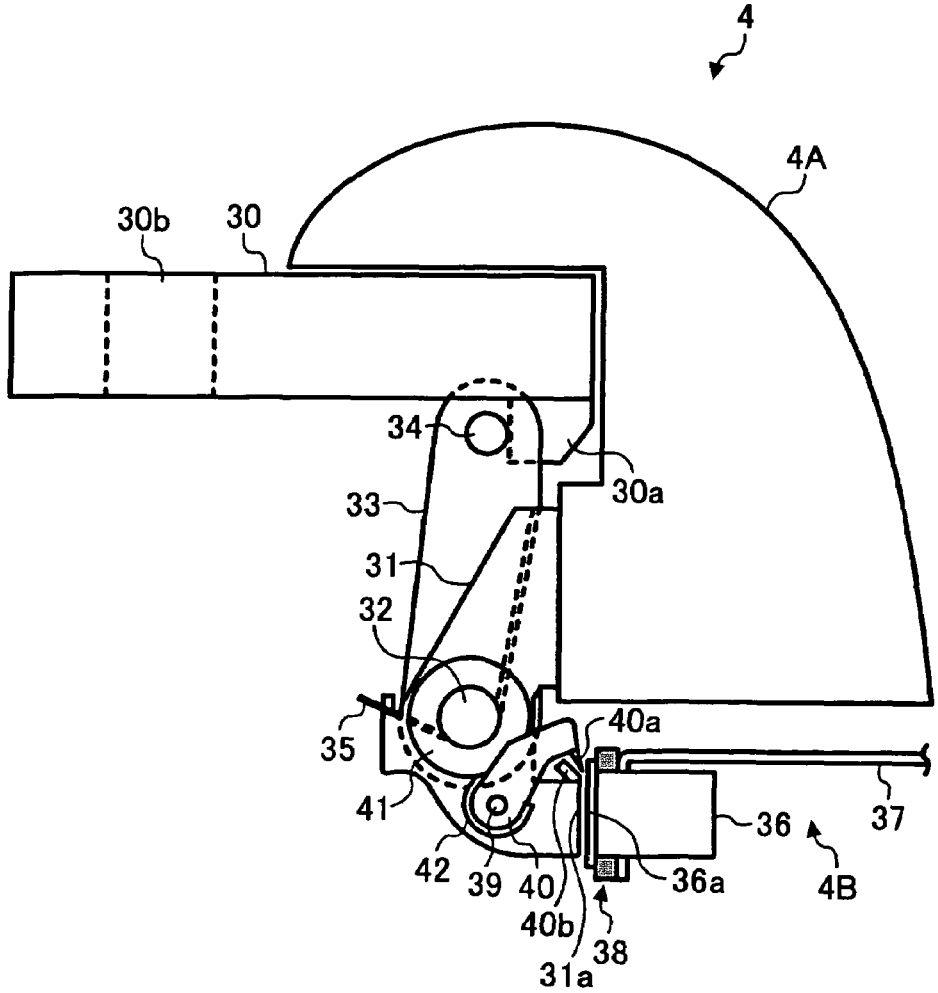
FIG. 3 is a schematic side view of a sheet feed unit of FIG. 1.

The sheet feed unit 4 is disposed under the image forming unit 2, and includes a sheet cassette 4A to store a recording medium such as transfer sheet, and a sheet feed unit body 4B (shown in FIG. 3).

In FIG. 1, the sheet feed unit 4 includes two sheet cassettes 4A in a double-decked manner, for example, but the number of the sheet cassettes 4A is not limited to two. As shown in FIG. 1, the sheet feed unit 4 also includes a sheet feed device 4C.

The double-face copy unit 6 is used to reverse a face of recording medium (e.g., transfer sheet) for a double-face copy on one sheet.

In the image forming apparatus 1, a recording medium (e.g., transfer sheet) is fed from the sheet feed unit 4 or the manual feed unit 5 to pair of registration rollers 11 via a transport roller 10.

The pair of registration rollers 11 feeds the recording medium (e.g., transfer sheet) to a transfer unit while adjusting sheet-feed timing with a timing of toner image formation in the image forming unit 2.

The transfer unit includes a transfer belt 7, wherein a toner image is transferred from the transfer belt 7 to the recording medium (e.g., transfer sheet).

The recording medium (e.g., transfer sheet) having an unfixed toner image is further transported to a pair of fixing rollers 8 shown in FIG. 1 by a traveling movement of the transfer belt 7.

The pair of fixing rollers 8 sandwich the recording medium (e.g., transfer sheet) therebetween. The pair of fixing rollers 8 apply heat and pressure to the recording medium to fix the toner image on the recording medium. Then the recording medium is further transported to an upper portion of the image forming apparatus 1.

As shown in FIG. 1, a switch pawl 12 is disposed above the pair of fixing rollers 8. The switch pawl 12 can selectively switch a sheet transport direction to a sheet ejector 9 or the double-face copy unit 6.

When the switch pawl 12 is at a position expressed by solid-line, the recording medium (e.g., transfer sheet) is guided to the sheet ejector 9, and when the switch pawl 12 is at a position expressed by dotted-line, the recording medium is guided to the double-face copy unit 6.

Hereinafter, the double-face copy unit 6 is explained in detail.

As shown in FIG. 1, the double-face copy unit 6 includes a reverse pawl 13, a reverse roller 14, a switchback path 15, and a double-face copy transport path 16.

The reverse pawl 13 is provided in proximity with an inlet of the double-face copy unit 6, and the reverse roller 14 is provided next to the reverse pawl 13 as shown in FIG. 1.

When the recording medium (e.g., transfer sheet) is transported to the double-face copy unit 6 with an effect of the switch pawl 12, the reverse pawl 13 is at a position expressed by solid-line.

Under such condition, the reverse roller 14 rotates in one direction and feeds the recording medium (e.g., transfer sheet) to the switchback path 15. When a rear end of the recording medium passes through the reverse pawl 13, the reverse pawl 13 changes its position to a position expressed by dotted-lines in FIG. 1, and the reverse roller 14 starts to rotate in an opposite direction.

With such changeover of the reverse pawl 13 and the reverse roller 14, the rear end of the recording medium (e.g., transfer sheet) becomes a front end of the recording medium, and is further transported through the double-face copy transport path 16 to the pair of registration rollers 11 again.

At this time, the face of the recording medium (e.g., transfer sheet) is reversed. Accordingly, a toner image is transferred to a not-printed face of the recording medium (i.e., a back face of the recording medium with respect to a face already having a fixed image) at the transfer unit.

Hereinafter, the sheet feed unit 4 according to an example embodiment is explained in detail.

Figure 2:
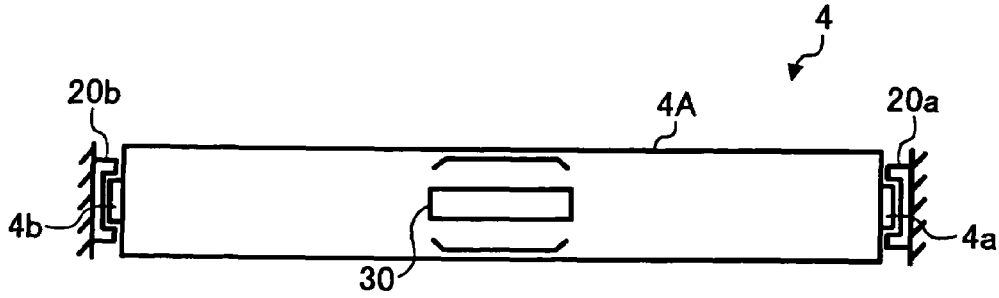
FIG. 2 is a schematic front view of a sheet feed unit of FIG. 1.

FIG. 2 is a schematic front view of the sheet feed unit 4. As shown in FIGS. 2 and 3, the sheet feed unit 4 includes the sheet cassette 4A and the sheet feed unit body 4B, wherein the sheet cassette 4A is withdrawable from the sheet feed unit body 4B.

An operator can see the sheet feed unit 4 as shown in FIG. 2 when ready to withdraw the sheet cassette 4A from the sheet feed unit body 4B or insert the sheet cassette 4A to the sheet feed unit body 4B.

In another words, FIG. 2 shows a condition when the sheet cassette 4A is set in the sheet feed unit body 4B provided in the image forming apparatus body 1A.

As shown in FIG. 3, the sheet cassette 4A is provided with a grip 30 having a hollow space 30*b*, by which the operator can easily withdraw or insert the sheet cassette 4A when conducting sheet-refilling or sheet-replacement.

Figure 4A:
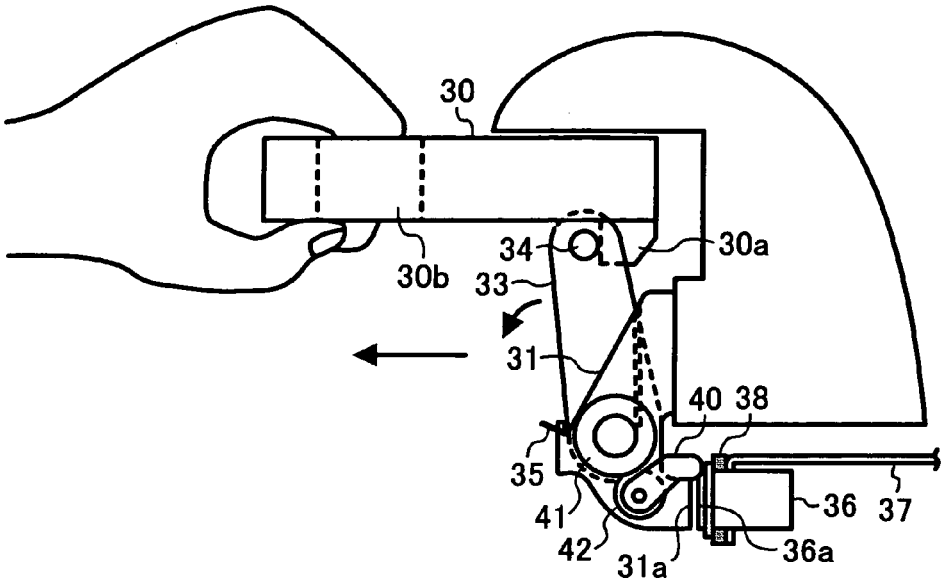
FIGS. 4A and 4B show schematic side views of a sheet feed unit, in which a sheet cassette is withdrawn from a sheet feed unit body.
Figure 4B:
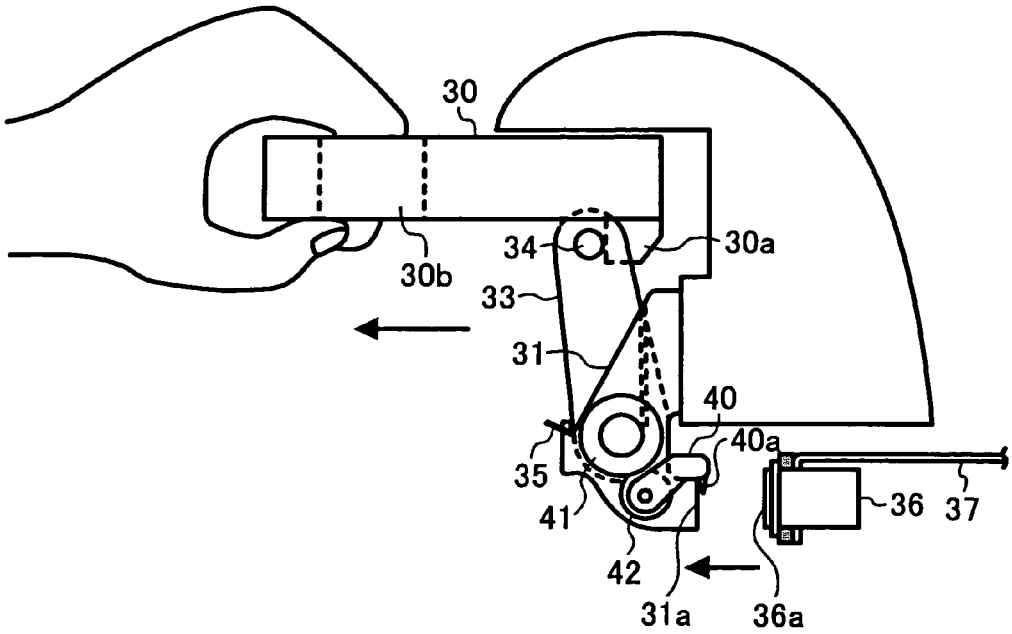

As shown in FIGS. 4A and 4B, the operator can hold the grip 30 by hand because the grip 30 has the hollow space 30*b*. In FIGS. 4A and 4B, the operator holds the grip 30 by hand from an upper side of the grip 30. In addition to such holding, the operator can hold the grip 30 by hand from a lower side of the grip 30 because of the hollow space 30*b*.

In general, conventional sheet cassettes are not provided with the grip 30 having the hollow space 30*b*, but is instead provided with a holding area, wherein an operator can hold the holding area only from one side of the sheet cassette such as lower side of the sheet cassette.

Thereby an operator can take a limited posture when withdrawing or inserting the sheet cassette in a conventional image forming apparatus. Such posture may not be user friendly for some people, especially for people having a disability.

Because the grip 30 can be held from an upper and a lower side of the grip 30, an operator including one having disabilities can choose a user-friendly posture when holding the grip 30.

Furthermore, an operator can use a tool to catch the grip 30. For example, the operator can catch the grip 30 by hooking a hook-like tool in the hollow space 30*b* and can withdraw the sheet cassette 4A from the sheet feed unit body 4B with such hook-like tool.

The sheet cassette 4A includes convexed portions 4*a* and 4*b*, which extend along lateral sides of the sheet cassette 4A as shown in FIG. 2, by which the sheet cassette 4A is slidably supported by guide rails 20*a*, 20*b* provided on the sheet feed unit body 4B.

FIG. 3 is a schematic side view of a configuration of the sheet feed unit 4. In FIG. 3, the sheet cassette 4A is set in a predetermined position in the sheet feed unit body 4B. The recording medium can be fed for image forming when the sheet cassette 4A is set in the predetermined position in the sheet feed unit body 4B.

The operator can move the sheet cassette 4A in a direction from right to left or left to right in the FIG. 3 by using the grip 30. In other words, the sheet cassette 4A is slidable along the above-mentioned guide rails 20*a* and 20*b*.

As shown in FIG. 3, the sheet cassette 4A is provided with a bracket 31. The bracket 31 is coupled to an arm 33 via a first shaft 32, and the arm 33 is coupled to the first shaft 32 at one end portion of the arm 33.

As shown in FIG. 3, the arm 33 is pivotably supported by the bracket 31 with the first shaft 32, wherein the first shaft 32 functions as fulcrum.

As also shown in FIG. 3, the arm 33 is coupled to a second shaft 34 at another end portion of the arm 33, which is opposite to the above-mentioned end portion of the arm 33.

As shown in FIG. 3, the second shaft 34 contacts a rib 30*a* provided on one end of the grip 30.

As also shown in FIG. 3, the first shaft 32 is attached with a twisted coil spring 35.

With an effect of the twisted coil spring 35, the arm 33 receives a pivotable force, by which the second shaft 34 coupled to the arm 33 is biased to the rib 30*a*. Accordingly, the twisted coil spring 35 biases the sheet cassette 4A toward the sheet feed unit body 4B.

As shown in FIG. 3, the sheet feed unit body 4B includes a magnet 36, a frame 37, and an elastic member 38, wherein the elastic member 38 is sandwiched by the magnet 36 and frame 37 and functions as shock absorber.

As shown in FIG. 3, a separation claw 40 is provided under the bracket 31, the separation claw 40 being coupled to a third shaft 39.

The separation claw 40 includes a tip portion 40*a* having a wedge shape, and pivots with a movement of the third shaft 39.

As shown in FIG. 3, the first shaft 32 is coupled to a first gear 41, and the third shaft 39 is coupled to a second gear 42, while the first gear 41 and the second gear 42 mesh each other.

Under such configuration, the first gear 41 and the second gear 42 rotate inter-lockingly, thereby the arm 33 and the separation claw 40 also moves inter-lockingly.

As above-mentioned, the sheet feed unit body 4B includes the frame 37 having the magnet 36, wherein the elastic member 38 is sandwiched between the magnet 36 and the frame 37.

The magnet 36 includes a magnet face 36*a*, and the bracket 31 includes a magnet contact face 31*a* as shown in FIG. 3, wherein the magnet contact face 31*a* is provided at one end of the bracket 31.

The magnet contact face 31*a* is attracted and attached to the magnet face 36*a* with magnetic force.

Although not shown in FIG. 3, a magnet (not shown) can be provided to an end face of the bracket 31 and a magnet contact face (not shown) can be provided on the frame 37 instead of the configuration shown by FIG. 3.

The twisted coil spring 35 constantly exerts a pivotable force in a clockwise direction in FIG. 3 with respect to the arm 33, and by such force the sheet cassette 4A can be maintained in a predetermined position in the sheet feed unit body 4B.

FIGS. 4A and 4B shows a case when an operator withdraws the sheet cassette 4A from the sheet feed unit body 4B by pulling the grip 30. In other words, FIGS. 4A and 4B shows schematic side views of the image forming apparatus 1 when the operator withdraws the sheet cassette 4A from the image forming apparatus body 1A.

When the operator pulls the grip 30 in a direction shown by an arrow in FIG. 4A, the rib 30*a* exerts a force to the second shaft 34, and such force pivots the arm 33 in a counter-clockwise direction in FIG. 4A.

Then the first gear 41 rotates in a counter-clockwise direction in FIG. 4A, and the second gear 42 rotates in a clockwise direction in FIG. 4A.

With such rotations of the first gear 41 and the second gear 42, the separation claw 40 pivots in a clockwise direction in FIG. 4A.

Then, the tip portion 40*a* of the separation claw 40 is inserted in a space between the bracket 31 and the magnet 36.

As shown in FIG. 3, the tip portion 40*a* has a cross-section having a wedge shape. Accordingly, when the separation claw 40 pivots in a clockwise direction for the withdrawing operation of the sheet cassette 4A, the tip portion 40*a* of the separation claw 40 can be easily inserted in the space between the bracket 31 and the magnet 36.

With such separation claw 40, the operator can withdraw the sheet cassette 4A from the sheet feed unit body 4B with a relatively smaller force because the separation claw 40 inserted between the bracket 31 and the magnet 36 reduces the effect of the magnetic force formed between the bracket 31 and the magnet 36.

Figure 5:
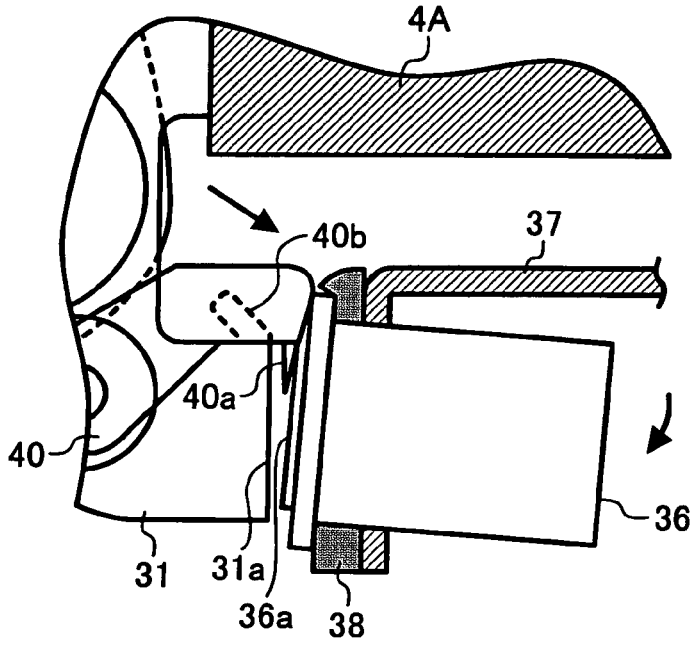
FIG. 5 is a schematic side view of a sheet feed unit for explaining withdrawal of a sheet cassette from a sheet feed unit body, in which a tip portion of separation claw is inserted between a bracket and a magnet.

FIG. 5 is an expanded schematic cross-sectional view around the separation claw 40, in which the tip portion 40*a* of the separation claw 40 is inserted in a space between the bracket 31 and the magnet 36.

The magnet face 36*a* of the magnet 36 can be made of sheet plate, for example. The shape of the sheet plate includes a flat shape and comb-like shape, for example. In case of the comb-like shape, the sheet plate may include a plurality of teeth shaped like a comb.

The magnet contact face 31*a* of the bracket 31 is attracted and attached to the magnet face 36*a* having such shaped sheet plate.

Accordingly, when the sheet feed cassette 4A is set in the sheet feed unit body 4B, the magnet face 36*a* and the magnet contact face 31 a contact with each other.

The tip portion 40*a* of the separation claw 40 can also be formed in a comb-like shape as in the magnet face 36*a*.

If both of the tip portion 40*a* of the separation claw 40 and the magnet face 36*a* are formed in a comb-like shape having a plurality of teeth, and if the teeth of the tip portion 40*a* and the magnet face 36*a* can be arranged in a zigzag manner so that the teeth of the tip portion 40*a* and the magnet face 36*a* can mesh with each other when the separation claw 40 is inserted into a space between the bracket 31 and the magnet 36, the separation claw 40 can be easily inserted into the space between the bracket 31 and the magnet 36.

When the tip portion 40*a* of the separation claw 40 is inserted into a space between the bracket 31 and the magnet 36, the separation claw 40 applies a force to the magnet 36 as shown in FIG. 5, by which the elastic member 38 is elastically deformed. With such deformation of the elastic member 38, the magnet 36 may pivot in a clockwise direction with some degree of movement as shown in FIG. 5.

With such movement of the magnet 36, the magnet 36 is pushed away from the bracket 31 from an upper side of the magnet face 36*a*.

When the operator further pulls the grip 30 in the direction shown by an arrow in FIG. 4A, the sheet cassette 4A slides along the guide rails 20*a* and 20*b*. Consequently, the sheet cassette 4A can be withdrawn from the sheet feed unit body 4B of the image forming apparatus body 1A.

With the above-described configuration having the separation claw 40, the bracket 31 can be detached from the magnet 36 with a relatively smaller force compared to a case of pulling the sheet cassette not equipped with the separation claw 40 in a horizontal direction.

As such, the operator can withdraw the sheet cassette 4A from the image forming apparatus body 1A with a relatively smaller force. FIG. 4B shows a state that the bracket 31 is detached from the magnet 36.

When the operator releases his hand from the grip 30 or lowers a pulling force of the grip 30, the arm 33 pivots in a clockwise direction in FIGS. 4A and 4B with a biasing force of the twisted coil spring 35.

With such biasing force of the twisted coil spring 35, and the magnetic force formed between the magnet 36 and the bracket 31, an operator can easily set the sheet cassette 4A in the sheet feed unit body 4B.

Then, the arm 33 and the grip 30 return to the position shown in FIG. 3, and at such position the image forming apparatus 1 can conduct an image forming process.

When the sheet cassette 4A is set in the sheet feed unit body 4B of the image forming apparatus body 1A, the arm 33, the grip 30, and other components are maintained in the configuration shown in FIG. 3.

Figure 6:
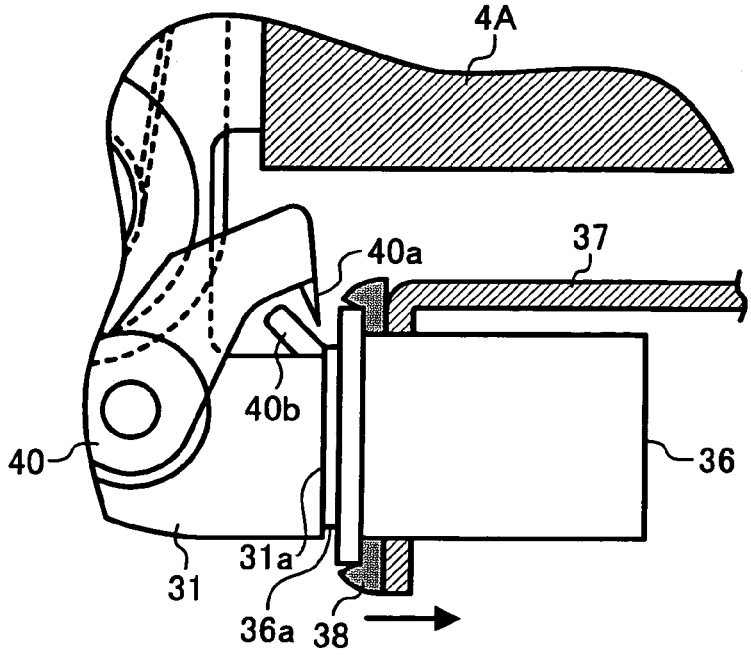
FIG. 6 is a schematic side view of a sheet feed unit for explaining the operational condition of a magnet, an elastic member and a frame of a sheet feed unit body when a sheet cassette is forcefully pushed into a sheet feed unit body.

FIG. 6 is an expanded schematic cross-sectional view of the configuration around the magnet 36, the elastic member 38, and the frame 37 of the sheet feed unit body 4B, in which the sheet cassette 4A is strongly pushed to the sheet feed unit body 4B of the image forming apparatus body 1A.

In the above-described example embodiment, the positioning of the sheet cassette 4A in the sheet feed unit body 4B of the image forming apparatus body 1A is determined with the bracket 31 and the magnet 36.

When the sheet cassette 4A is strongly pushed into the sheet feed unit body 4B, the magnet contact face 31*a* of the bracket 31 contacts the magnet face 36*a* of the magnet 36 at first, and the sheet cassette 4A receives an unfavorably strong reaction force as a whole.

Accordingly, if the sheet cassette 4A is strongly pushed into the sheet feed unit body 4B of the image forming apparatus body 1A, components of the sheet cassette 4A may be damaged. For example, a connection portion which connects the bracket 31 and the sheet cassette 4A may be damaged.

In order to prevent such damage, the sheet feed unit 4 shown in FIG. 3 includes the elastic member 38 placed between the magnet 36 and the frame 37 of the sheet feed unit body 4B, wherein the elastic member 38 can dampen shocks which may occur when the sheet cassette 4A is strongly pushed into the sheet feed unit body 4B of the image forming apparatus body 1A.

If the sheet cassette 4A is pushed into the sheet feed unit body 4B with a relatively larger force, the elastic member 38 elastically deforms to dampen the effect of such force. With such damping effect of the elastic member 38, a force to be applied to the connection portion of the bracket 31 and the sheet cassette 4A can be dampened.

After deformation, the elastic member 38 returns to its original shape with elasticity, and then the sheet cassette 4A can be set in a predetermined position in the sheet feed unit body 4B of the image forming apparatus unit 1A.

The elastic member 38 can be made of elastic material such as rubber and compression spring, for example.

Preferably, the separation claw 40 can be made of non-magnetic material, for example. By using the non-magnetic material for the separation claw 40, the separation claw 40 can be easily inserted to a space between the bracket 31 and the magnet 36 or withdrawn from a space between the bracket 31 and the magnet 36 because the non-magnetic material may not be affected by a magnetic force formed between the bracket 31 and the magnet 36.

Furthermore, the bracket 31 also includes a guide member 40*b* as shown in FIGS. 3, 5, and 6, which is used to guide the tip portion 40*a* of the separation claw 40 to a space between the bracket 31 and the magnet 36 when the separation claw 40 pivots in a clockwise direction.

Although the above-described example sheet feed unit is applied to an image forming apparatus such as copier, such sheet feed unit can be applied to other apparatuses such as facsimile, printer, or the like which include a withdrawable sheet feed unit therein.

Numerous additional modifications and variations are possible in light of the above teachings. It is therefore to be understood that within the scope of the appended claims, the disclosure of the present invention may be practiced otherwise than as specifically described herein.

This application claims priority from Japanese patent applications No. 2004-369341 filed on Dec. 21, 2004 in the Japan Patent Office, the entire contents of which are hereby incorporated by reference herein.

What is claimed is:

1. A sheet feed unit for use in an image forming apparatus and used for storing and feeding a recording medium, the sheet feed unit comprising:

a sheet feed unit body, including:

a first frame, a first contact face being provided on the first frame; and a sheet cassette configured to be withdrawable from the sheet feed unit body, including:

a second frame, a second contact face being provided on the second frame and being configured to be attached to the first contact face when the sheet cassette is positioned in the sheet feed unit body; and a separator configured to be inserted between the first contact face and the second contact face to separate the sheet cassette and the sheet feed unit body when the sheet cassette is withdrawn from being positioned in the sheet feed unit body, and configured to be disengaged from the first contact face and the second contact face to set the sheet cassette when positioned in the sheet feed unit body when the sheet cassette is inserted so as to be positioned in the sheet feed unit body.

2. The sheet feed unit according to claim 1, wherein the first contact face includes a magnet to attach the first contact face to the second contact face with a magnetic force.

3. The sheet feed unit according to claim 2, wherein the first contact face is provided with an elastic member placed between the first contact face and the first frame, and the elastic member comprises a shock absorber.

4. The sheet feed unit according to claim 1, wherein the second contact face includes a magnet to attach the second contact face to the first contact face with a magnetic force.

5. The sheet feed unit according to claim 4, wherein the second contact face is provided with an elastic member placed between the second contact face and the second frame, and the elastic member comprises a shock absorber.

6. The sheet feed unit according to claim 1, wherein the separator comprises a non-magnetic material.

7. The sheet feed unit according to claim 1, wherein the separator includes a separation claw.

8. The sheet feed unit according to claim 1, wherein the separator is pivotabley supported by the second frame.

9. The sheet feed unit according to claim 1, wherein the sheet cassette includes a grip configured to withdrawably move the cassette with respect to the sheet feed unit body.

10. The sheet feed unit according to claim 9, wherein the grip includes a hollow portion to facilitate holding of the grip.

11. The sheet feed unit according to claim 1, further comprising a biasing member configured to maintain the sheet cassette in the position in the sheet feed unit body.

12. The sheet feed unit according to claim 11, wherein the biasing member comprises a spring.

13. The sheet feed unit according to claim 1, wherein the sheet cassette further comprises a pivotable arm connected to the separator.

14. The sheet feed unit according to claim 13, wherein the separator is inserted between the first contact face and the second contact face with a first pivot movement of the arm, and the separator is disengaged from the first contact face and the second contact face with a second pivot movement of the arm, and wherein the first and second pivot movement are in opposite directions with respect to each other.

15. The sheet feed unit according to claim 1, further comprising a sheet feed device configured to feed the recording medium for image forming.

16. An image forming apparatus, comprising:

an image forming unit configured to form an toner image;

a transfer unit configured to transfer the toner image to a recording medium; and a sheet feed unit configured to feed the recording medium to the transfer unit, comprising:

a sheet feed unit body, including:

a first frame, a first contact face being provided on the first frame; and a sheet cassette configured to be withdrawable from the sheet feed unit body, including:

a second frame, a second contact face being provided on the second frame and being configured to be attached to the first contact face when the sheet cassette is positioned in the sheet feed unit body; and a separator configured to be inserted between the first contact face and the second contact face to separate the sheet cassette and the sheet feed unit body when the sheet cassette is withdrawn from being positioned in the sheet feed unit body, and configured to be disengaged from the first contact face and the second contact face to set the sheet cassette at the position in the sheet feed unit body when the sheet cassette is inserted so as to be positioned in the sheet feed unit body.

* * * * *